US006167571B1

(12) United States Patent
Cheng

(10) Patent No.: US 6,167,571 B1
(45) Date of Patent: Jan. 2, 2001

(54) WADERS FOR FISHING OR HUNTING

(76) Inventor: Hsien-Hsiung Cheng, 1F, No. 1, Lane 169, Ta Hu Shan Chaung Street, Nei Hu Area, Taipei City (TW)

( * ) Notice: Under 35 U.S.C. 154(b), the term of this patent shall be extended for 0 days.

(21) Appl. No.: 09/349,456

(22) Filed: Jul. 8, 1999

(51) Int. Cl.[7] ..... A41D 13/02; A41D 13/06; A41D 1/08

(52) U.S. Cl. ..... 2/227; 36/1.5; 36/109; 2/242; 2/230; 2/87

(58) Field of Search ..... 2/227, 69.79, 242, 2/230, 232, 82; 36/2 R, 1.5, 109

(56) References Cited

U.S. PATENT DOCUMENTS

| | | | | |
|---|---|---|---|---|
| D. 285,140 | * | 8/1986 | Ellenberger | 36/2 R |
| 4,912,860 | * | 4/1990 | Keller | 2/82 |
| 5,022,096 | * | 6/1991 | Pacanowsky | 2/82 |
| 5,081,718 | * | 1/1992 | Carman et al. | 2/227 |

* cited by examiner

*Primary Examiner*—Andy Falik
(74) *Attorney, Agent, or Firm*—Browdy and Neimark

(57) ABSTRACT

An outerwear for a fisherman or hunter is formed of two leg portions and a hip-waist portion extending upward from the leg portions to the waist. The leg portions are made of a foam material having waterproof, nonbreathable, and thermal effects. The hip-waist portion is made of a waterproof and breathable material.

5 Claims, 4 Drawing Sheets

WADERS FOR FISHING OR HUNTING

FIELD OF THE INVENTION

The present invention relates generally to an outerwear for fishing or hunting, and more particularly to waterproof thermal trousers which are light in weight and breathable for use in fishing or hunting.

BACKGROUND OF THE INVENTION

The conventional waterproof trousers worn by a fisherman or hunter are generally grouped as hippers 1 and waders 2, as shown in FIGS. 1 and 2. The hippers 1 are suitable in shallow water. The waders are high waterproof trousers with bootlike parts for the feet and are worn by fishermen or hunters for wading in deep water. The waders 2 are generally made of a PU material and are therefore light in weight, waterproof, and breathable; nevertheless they are not well insulated to help retain the body heat of a wearer thereof.

As shown in FIG. 3, a prior art waders 3 is a waterproof thermal waders; nevertheless the waders 3 is rather heavy and is not ventilated. The heavy weight of the waders 3 hinders the movement of a wearer thereof. The lack of a ventilating means of the waders 3 is perhaps the most serious drawback of the waders 3.

SUMMARY OF THE INVENTION

It is therefore the primary objective of the present invention to provide a breathable thermal outerwear for use by a fisherman or hunter.

It is another objective of the present invention to provide a lightweight outerwear for use by a fisherman or hunter to wade in water with ease.

In keeping with the principle of the present invention, the foregoing objectives of the present invention are attained by an outerwear comprising two leg portions and a hip-waist portion extending from the leg portions to the waist. The two leg portions are made of a foam material having waterproof, nonbreathable, and thermal insulating properties. The hip-waist portion is made of a waterproof and breathable material, such as the polyurethane (PU) material.

The foregoing objectives, features, functions, and advantages of the present invention will be more readily understood upon deliberation of the following detailed description of the embodiments of the present invention with reference to the accompanying drawings.

DETAILED DESCRIPTION OF THE INVENTION

Figure 1:
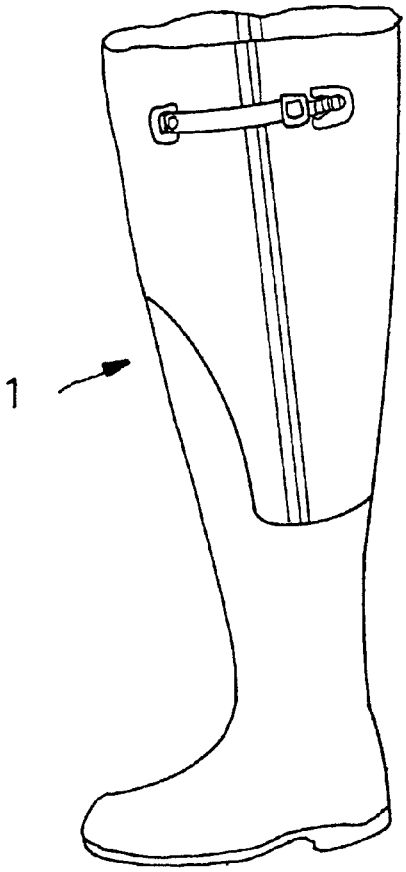
FIG. 1 PRIOR ART
FIG. 1 shows a perspective view of a pair of hippers of the prior art.
Figure 2:
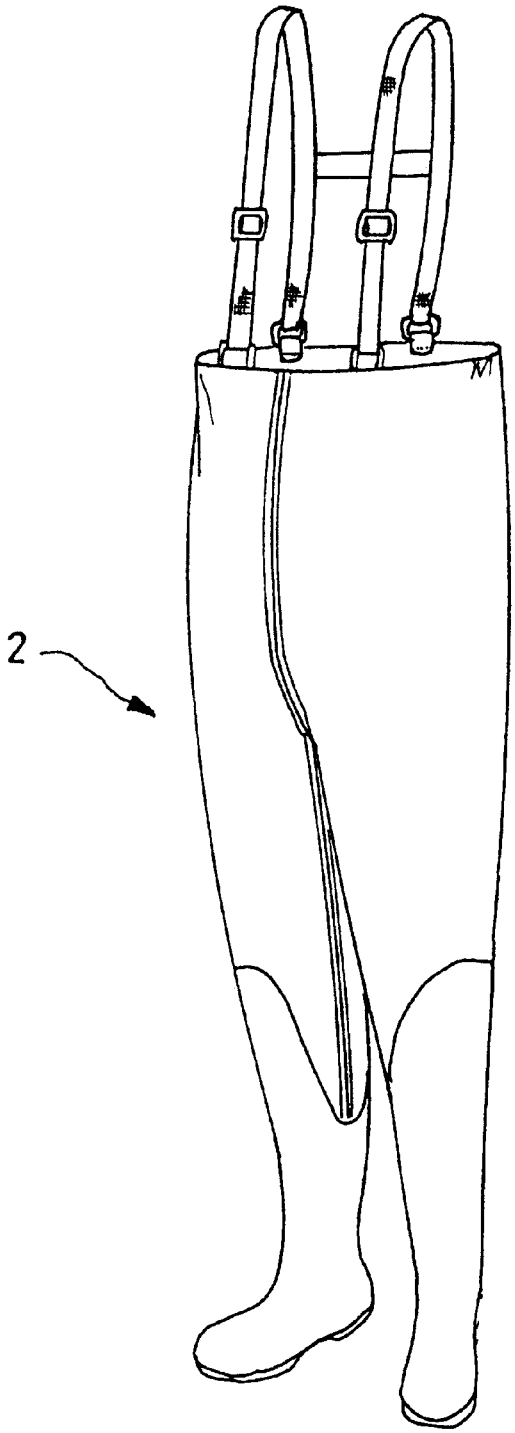
FIG. 2 PRIOR ART
FIG. 2 shows a perspective view of a pair of waders of the prior art.
Figure 3:
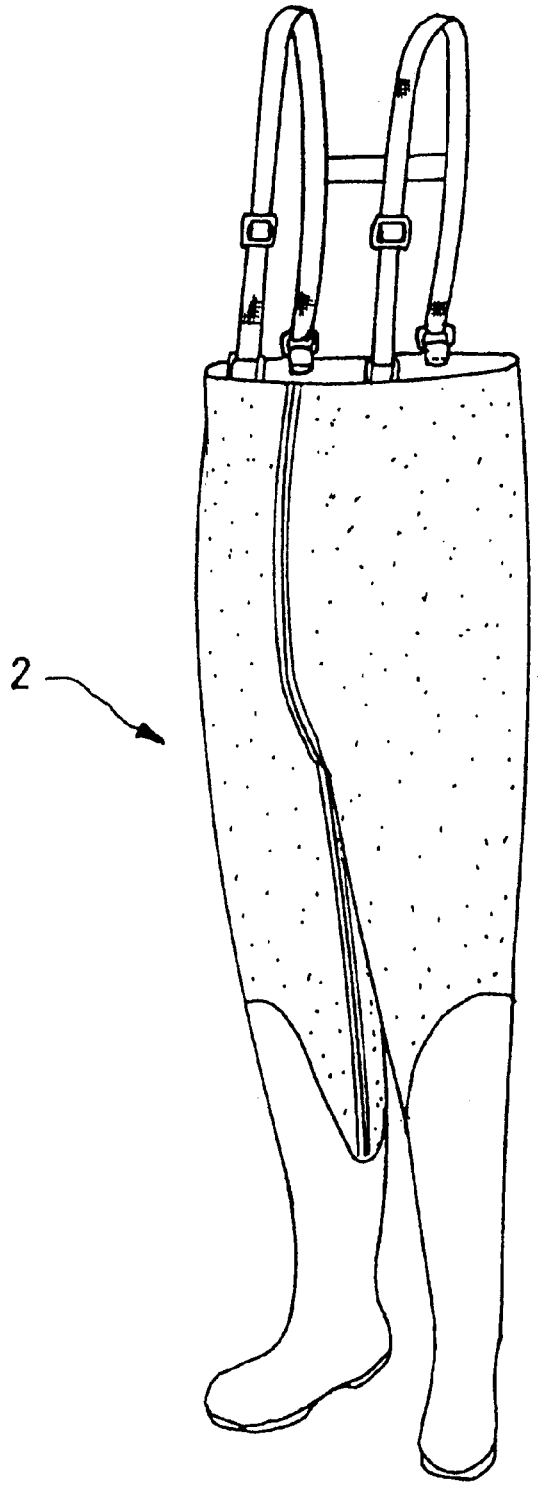
FIG. 3 PRIOR ART
FIG. 3 shows a perspective view of another pair of waders of the prior art.
Figure 4:
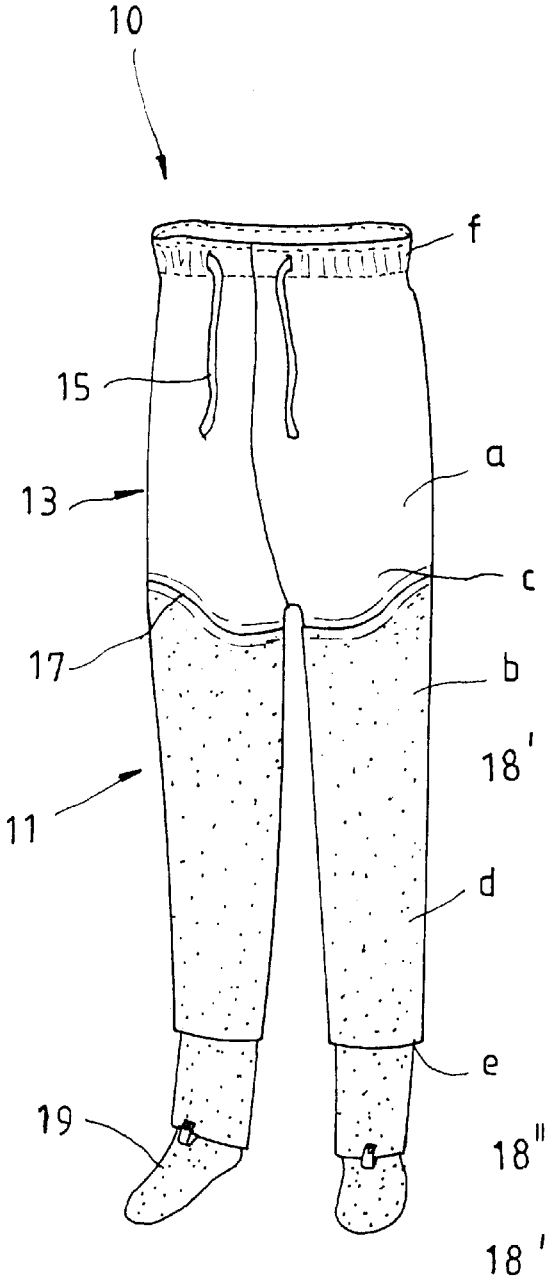
FIG. 4 shows a perspective view of a first preferred embodiment of the present invention.

As shown in FIG. 4, an outerwear 10 embodied in the present invention is intended to be worn by a fisherman or hunter for wading in water and is formed of two leg portions 11 for the feet and the legs, and a hip-waist portion 13 extending upward from the leg portions 11 to reach the waist where a fastening strap 15 is provided.

The leg portions 11 have an upper demarcation 17 and are intended to accommodate thighs b, buttocks c, shins d, cuffs e, and two socks 18' detachably attached to cuffs e by clips 18" in a conventional manner so as to assure that the leg portions remain waterproof. The leg portions 11 including socks 18' are made of a foam material, such as neoprene, which has waterproof, nonbreathable, and thermal insulating properties. The hip-waist portion 13 is intended to accommodate the buttock-waist portion a and is waterproof and breathable. The hip-waist portion 13 is made of a polyurethane (PU) material.

Figure 5:
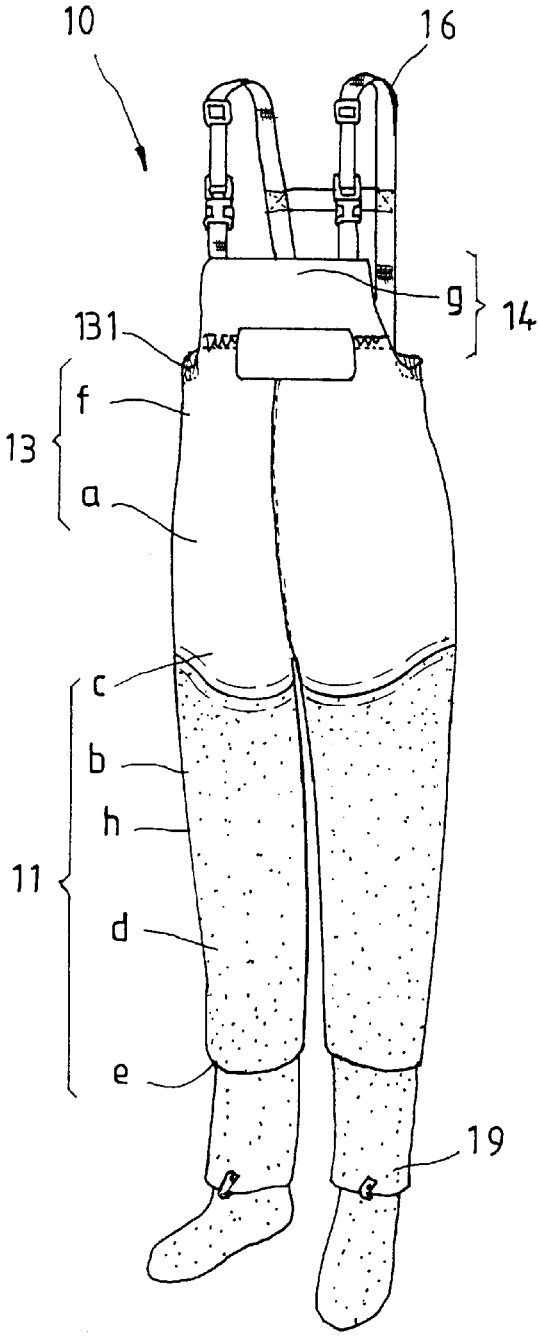
FIG. 5 shows a perspective view of a second preferred embodiment of the present invention.

As shown in FIG. 5, the outerwear 10 of the present invention is further formed of a chest portion 14 extending from the waist f to the chest g. The chest portion 14 is provided with two suspenders 16 passing over the shoulders to hold up the outerwear 10. The hip-waist portion 13 is provided with a tightening strap 131 in place of the fastening strap 15.

Figure 6:
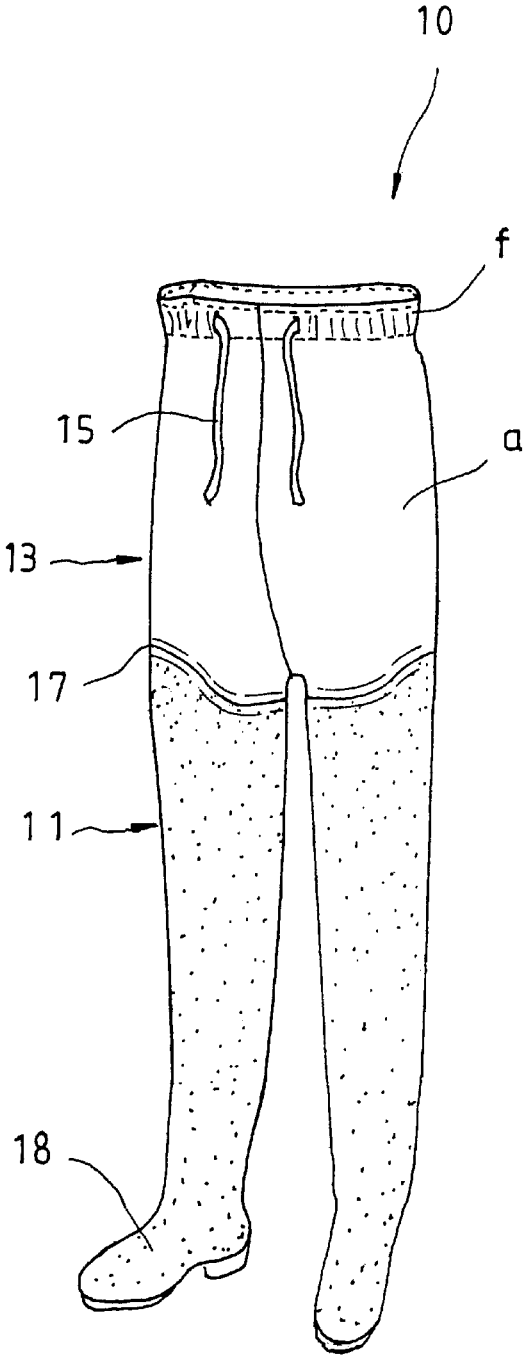
FIG. 6 shows a perspective view of a third preferred embodiment of the present invention.
Figure 7:
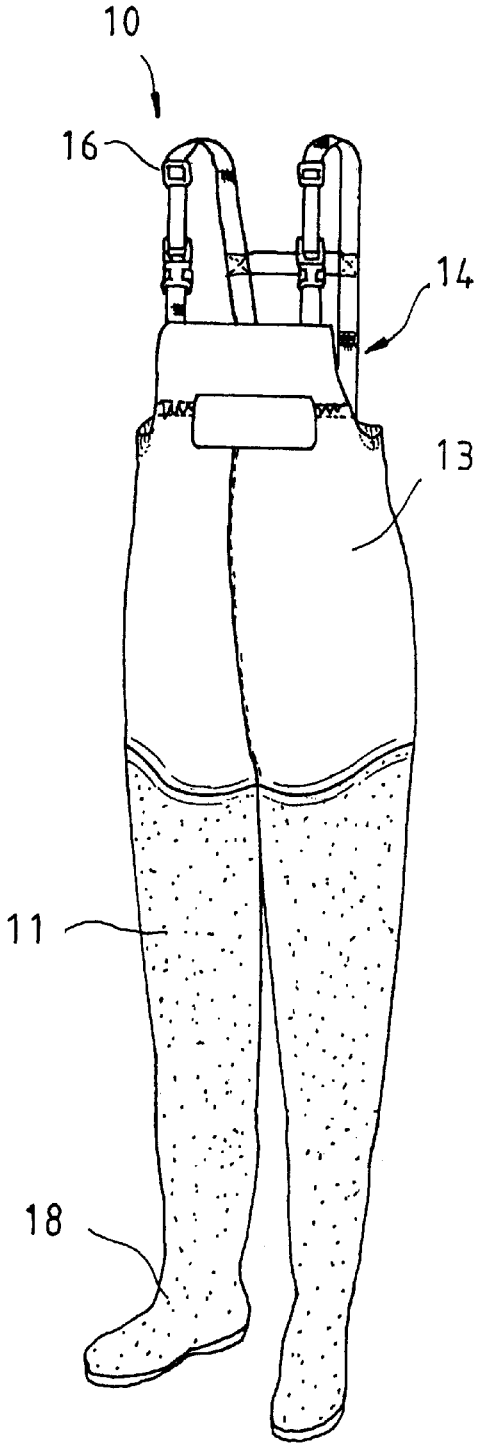
FIG. 7 shows a perspective view of a fourth preferred embodiment of the present invention.

As shown in FIGS. 6 and 7, the cuffs e of the leg portions 11 of the outerwear 10 of the present invention are fused with two boots 18 which are made of a rubber material.

The present invention is characterized by the leg portions 11 and the hip-waist portion 13 whereby the leg portions 11 are intended to accommodate thighs b, buttocks c, small legs d, cuffs e, and two socks 19. The leg portions 11 are made of a foam material which has waterproof, nonbreathable, and thermal insulating properties. The hip-waist portion 13 is intended to accommodate the buttock-waist portion a and is lightweight, waterproof, and breathable. The hip-waist portion 13 is made of a nylon or PU material. As shown in FIG. 5, the chest portion 14 of the outerwear 10 of the present invention extends from the waist f to the chest g. The chest portion 14 is made of a nylon or PU material and is thus lightweight, waterproof, and breathable.

The outerwear 10 of the present invention has a lower half portion including the tighs b, the small legs d, and the cuffs e of the two leg portions 11. The lower half portion and the two socks 19 are made of a foam material having waterproof, nonbreathable, and thermal insulating properties. The outerwear 10 of the present invention further has an upper half portion including the chest portion 14 and the hip-waist portion 13. The upper half portion is made of a nylon or PU material and is thus waterproof, breathable and lightweight. In other words, the outerwear 10 of the present invention has a breathable upper half portion and a thermal insulating lower half portion.

When a person is engaged in a fishing or hunting activity, he or she is likely to wade in water. In most instances, the water level may reach the knee portions h. If the knee portions remain in the cold water for a prolonged period of time, the body temperature of the person may drop to an extent that the person's health is seriously jeopardized. For this reason, the lower half portion of the outerwear 10 of the present invention is provided with thermal insulation, a waterproof and nonbreathable effect properties. In view of the knee portion h being the joint between the thigh and the leg between the knee and the ankle, the mobility of the person wearing the outerwear 10 of the present invention is most likely retarded if the knee portion h serves as the connection point between two portions made of two different materials. For this reason, the connection point of the present invention is located under the hips a. The lower half portion of the outerwear 10 of the present invention is thus made of a foam material having waterproof and thermal insulating properties.

The upper half portion of the outerwear 10 of the present invention is made of a nylon or PU material having only waterproof and breathable effects. In light of the upper half portion remaining above the water, the body heat and the body perspiration are reduced by the breathable upper half portion of the outerwear 10.

The outerwear 10 of the present invention is relatively light in weight as compared with the prior art outerwear. This is attributable to the fact that the upper half portion of the outerwear 10 of the present invention is made of a lightweight nylon or PU material, and that the lower half portion of the outerwear 10 is made of a foam thermal material which is relatively heavier. The outerwear 10 of the present invention is thus less likely to hinder the mobility of a fisherman or hunter wearing the outerwear 10.

The embodiments of the present invention described above are to be deemed in all respects as being merely illustrative and not restrictive. Accordingly, the present invention may be embodied in other specific forms without deviating from the spirit thereof. The present invention is therefore to be limited only by the scopes of the following appended claims.

What is claimed is:

1. An outerwear worn by a fisherman or hunter for wading in water, said outerwear comprising two leg portions and a hip-waist portion extending upward from said leg portions; wherein said two leg portions are made of a foam material having waterproof, nonbreathable, and thermal insulating properties; wherein said hip-waist portion is made of a waterproof and breathable material; and wherein said two leg portions are provided at a bottom thereof with a sock detachably fastened therewith whereby said sock is made of a foam material having waterproof, nonbreathable, and thermal insulating properties.

2. The outerwear as defined in claim 1, wherein said leg portions have an upper demarcation made of two different materials whereby said leg portions are made of said foam material having waterproof, nonbreathable and thermal insulation properties; and wherein said hip-waist portion above said demarcation is made of said waterproof and breathable material.

3. The outerwear as defined in claim 1 further comprising a chest portion extending upward from said hip-waist portion whereby said chest portion is provided with two suspenders passing over the shoulders of a user to hold up said outerwear.

4. The outerwear as defined in claim 1, wherein said foam material is neoprene.

5. The outerwear as defined in claim 1, wherein said waterproof and breathable material is polyurethane.

* * * * *